United States Patent [19]

Gerhold et al.

[11] 4,158,526

[45] Jun. 19, 1979

[54] TURBINE ASSEMBLY INCLUDING A ROTATABLE LIQUID COLLECTION RING

[75] Inventors: Bruce W. Gerhold, Rexford; Herman M. Leibowitz, Schenectady, both of N.Y.

[73] Assignee: General Electric Company, Schenectady, N.Y.

[21] Appl. No.: 867,952

[22] Filed: Jan. 9, 1978

[51] Int. Cl.[2] ..... F02C 7/12; F01D 5/18

[52] U.S. Cl. ..... 415/115; 416/95

[58] Field of Search ..... 415/114, 115, 116, 117; 416/95, 96 R, 97 R

[56] References Cited

U.S. PATENT DOCUMENTS

| | | | |
|---|---|---|---|
| 3,446,481 | 5/1969 | Kydd | 416/95 |
| 3,619,076 | 11/1971 | Kydd | 415/115 |
| 3,736,071 | 5/1973 | Kydd | 416/97 |
| 3,816,022 | 6/1974 | Day | 416/96 |

*Primary Examiner*—Louis J. Casaregola

*Attorney, Agent, or Firm*—Richard G. Jackson; Joseph T. Cohen; Leo I. MaLossi

[57] ABSTRACT

A turbine assembly is described comprising a casing, a rotor assembly disposed radially inwardly of the casing and adapted to discharge high velocity jets of liquid coolant toward the casing and a rotatable annular ring disposed intermediate the casing and rotor assembly. The ring includes a trough assembly so composed and arranged that liquid coolant impinging thereon is contained therein as a film and the ring rotates in response to such impingement. The ring speed is significantly less than the rotor speed such that erosion of the casing by the coolant is substantially reduced.

15 Claims, 3 Drawing Figures

TURBINE ASSEMBLY INCLUDING A ROTATABLE LIQUID COLLECTION RING

BACKGROUND OF THE INVENTION

This invention relates to a turbine machine including a rotatable liquid collection ring and to a process for liquid cooling the buckets of a turbine rotor.

Kydd, in U.S. Pat. Nos. 3,446,481 and 3,736,071, dicloses open-circuit liquid cooled turbines wherein liquid content of hot coolant fluid discharged from the turbine buckets is thereby thrown into an annular slot in register therewith in the wall of the turbine casing.

One problem arising in the operation of open circuit liquid cooled turbines, especially those employing high speed liquid cooled rotors, is erosion of stationary parts against which high speed jets of spent liquid coolant impinge, resulting ultimately in erosive wear thereof. Such stationary parts typically include, for example, the turbine casing.

It has now been found by practice of the present invention that this problem can be substantially minimized by providing a rotatable annular ring intermediate the casing and open circuit liquid-cooled rotor assembly. The ring includes a trough assembly so composed and arranged that liquid coolant impinging thereon is contained or temporarily held therein as a film and the ring rotates in response to such impingement. Provision is made for the ring speed to be significantly less than the rotor speed such that erosion of the casing by the coolant leaving the ring is substantially reduced relative to the amount of erosion occuring without such ring being provided.

DESCRIPTION OF THE INVENTION

Generally stated, in one aspect, the present invention provides a turbine machine comprising (A) a casing having a generally cylindrical inner surface and (B) a rotor assembly disposed radially inwardly of the casing and having a plurality of outlets adapted to discharge high-velocity jets of liquid coolant toward the inner surface of the casing. An annular ring mounted for rotation substantially about the axis of rotation of the rotor assembly is provided intermediate the casing and the rotor assembly. The ring is provided with a trough assembly including a recess opening toward the axis, a port opening toward the casing, and a perforate member between the recess and the port, which are in mutual flow communication through holes in the perforate member. The holes are sufficiently small in total transverse sectional area such that liquid coolant impinging on the trough is contained therein in the form of a liquid film on the perforate member and the ring rotates in response to impingement of the high-velocity coolant jets.

Generally stated, in another aspect, the present invention provides an improvement in the process of open-circuit liquid cooling a turbine rotor assembly wherein high velocity jets of spent liquid coolant are discharged outwardly from the rotor assembly toward the turbine casing, which comprises providing the above annular ring intermediate the casing and the rotor assembly, with the ring being mounted for rotation substantially about the axis of rotation of the assembly.

Initially discharged jets are impinged on the trough to effect both formation of a liquid film thereon and rotation of the ring. Subsequently discharged jets are impinged onto the film to both continue rotating the ring and replenish the film as liquid therefrom is discharged outwardly through the trough assembly.

BRIEF DESCRIPTION OF THE DRAWING

Practice of the present invention will become more fully apparent by referring to the following detailed description taken with the accompanying drawing wherein like numerals refer to similar elements throughout and.

DETAILED DESCRIPTION OF THE INVENTION AND MANNER AND PROCESS OF MAKING AND USING IT

Figure 1:
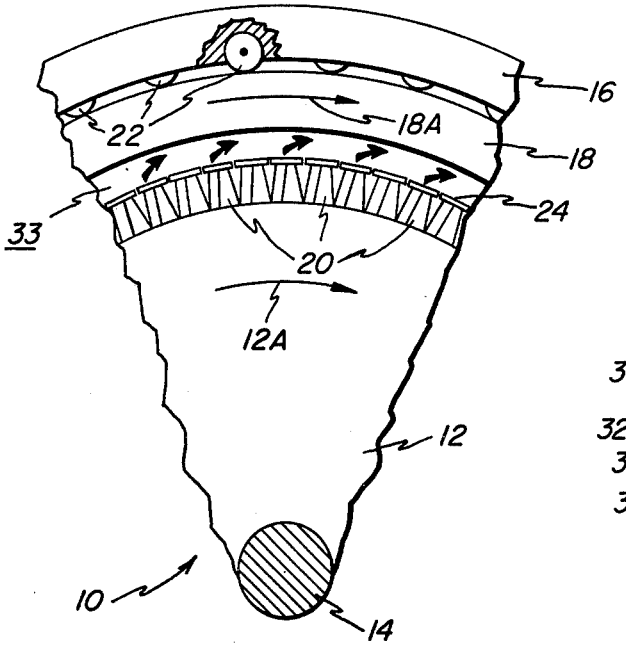
FIG. 1 is a fragmentary view, partly in section, illustrating the motive fluid entrance end of an axial flow gas turbine embodying the present invention and having a rotatable liquid collection ring intermediate the stationary casing and rotor assembly of the turbine.

Referring now to the drawing and more particularly to FIG. 1, there is shown motive fluid entrance end of axial flow gas turbine machine 10, which may be a gas turbine operated with ultra-high temperature motive fluid. The turbine includes a rotor assembly including turbine rotor or disc 12 mounted on turbine main shaft 14, with the disc extending substantially perpendicular to the shaft axis and having a plurality of turbine buckets 20 affixed to the outer rim thereof. The shaft and rotor assembly affixed thereto are rotatably supported within casing 16, which preferably is stationary and may be annular in shape as illustrated. Annular liquid collection ring 18 disposed intermediate the casing and buckets of the rotor assembly is mounted for rotation substantially about the axis of rotation of the rotor (which usually coincides with the longitudinal geometric axis of a balanced shaft 14). The ring may be thus mounted in any suitable manner and preferably is rotatably supported by a plurality of preferably uniformly spaced bearings 22 carried by the casing as illustrated.

The rotor assembly is provided with an open cirucit liquid coolant flow network (not shown), which may be of any suitable construction. Suitable networks are described in each of the above identified Kydd patents, which are incorporated herein by reference. The coolant network selected will have a plurality of discharge terminals 26 (FIG. 2), each having at least one hole 28 therethrough, each terminal being connected to one of the turbine buckets, either directly or, as shown, through a shroud element of shroud 24 having a plurality of such elements, each disposed atop and affixed to a turbine bucket.

As hot motive fluid is supplied axially of the turbine as shown by directional arrow 11 to the leading edges of the turbine buckets, the rotor assembly is rotated at a high speed in the rotational direction shown by arrow 12 resulting in the discharge through holes 28 of high-velocity jets comprising at least some quantity of liquid coolant. Such jets are schematically illustrated by the heavy arrows in the space 33 (FIG. 1) intermediate the ring and the rotor. Such jets have a resultant velocity in the direction shown by the arrows which comprises both a radially outward velocity component and a tangential velocity component. When the rotor assembly is rotated at typical operation speeds, e.g., 3600 rpm, the resultant velocity of the jets will be on the order of, for example, 1500 feet per second, principally in the tangential direction. When these jets impinge on the rotatable ring, it thereby is caused to rotate in the direction shown by arrow 18A in FIG. 1 at an angular speed which is less than the angular speed of the rotor assembly.

Figure 3:
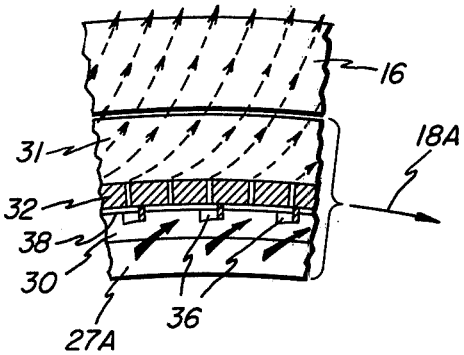
FIG. 3 is a sectional view taken on line 3—3 of FIG. 2.
Figure 2:
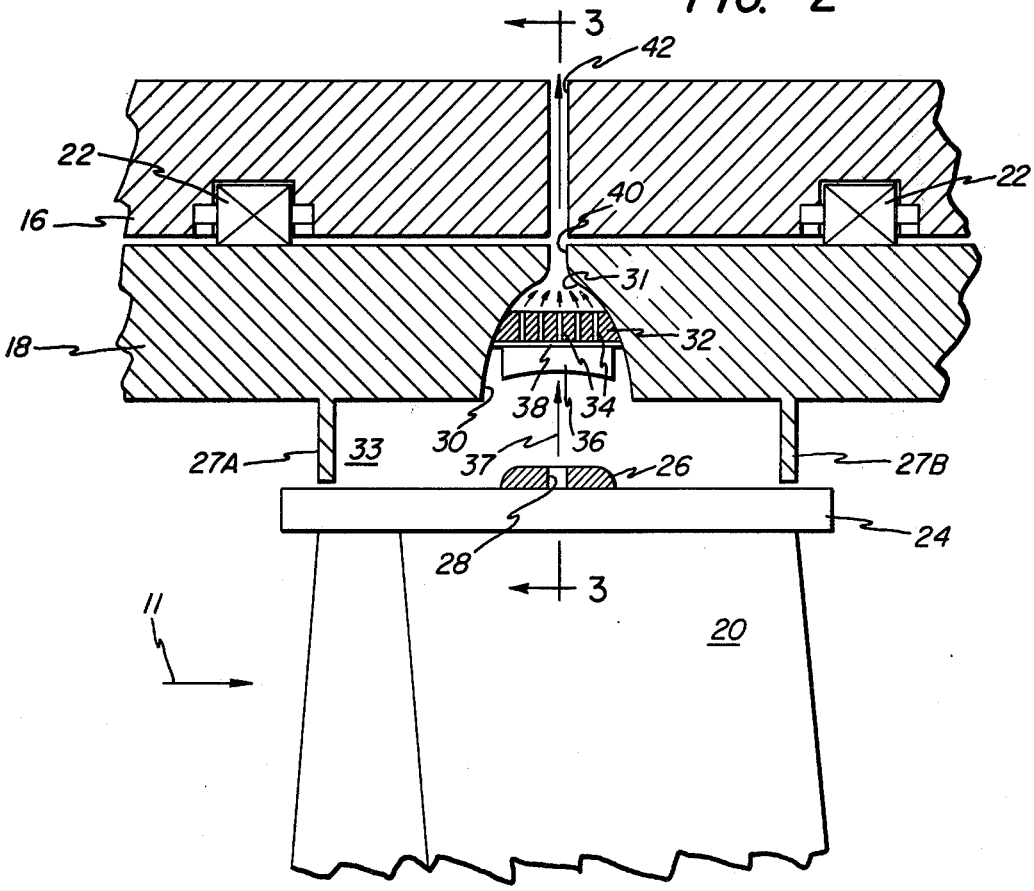
FIG. 2 is a fragmentary view, partly in section, and taken generally perpendicular to FIG. 1, illustrating the casing and collection ring in greater detail.

As shown in FIG. 2, wherein ring 18 and casing 16 are shown in longitudinal sectional view, the ring is provided with an annular trough system including annular recess 30 opening radially inwardly toward the rotor assembly (illustrated therein by bucket 20 and the shroud element 24 fixed to the distal end thereof, together with the terminal 26 thereon). The recess is in register with the outlets 28 (one shown) for receiving the high velocity jets (one shown schematically by arrow 37 in FIG. 2). As illustrated, this register relationship may be provided by having the annular recess in radial alignment with the outlet or outlets in terminal 26. The trough system further includes annular port 31 opening radially outwardly toward casing 16 and annular perforate member 32 disposed between the recess and the port. The perforate member may be supported in any suitable manner, e.g., as by welding the axially opposite ends thereof to the opposing surface portions of the ring. Additional support is provided in the illustrated embodiment by employing a width of port 31 which is smaller than the width of recess 30. Such construction helps in resisting displacement of the perforate member under the extremely high centrifugal forces applied thereto by the high velocity liquid containing jets. At least one and preferably a plurality of desirably uniformly spaced holes 34 extend through the perforate member for flow communication of the recess with the port. The number and size of holes 34 is selected to be sufficiently small in total transverse sectional area such that a body of liquid coolant discharged from outlets 28 and impinging on the trough is contained therein in the form of film 38 on the radially inner surface of the perforate member. Film formation is preferably aided by providing a plurality of vanes 36 projecting radially inwardly from the inner surface of the perforate member, preferably in uniformly circumferentially spaced apart manner as illustrated in FIG. 3. Desirably, such vanes will be arcuate in the direction longitudinally of the turbine as shown in FIG. 3 and may have an arcuate radially inner periphery as illustrated in FIG. 2.

The ring may include a pair of radially inwardly projecting annular ribs 27A and 27B terminating approximately the distal end of the bucket (or shroud, if provided, as illustrated) for confining the flow of hot motive fluid to a flow path through the plurality of openings between the various buckets.

The outlets 28 are preferably disposed in uniformly spaced apart relationship circumferentially of the rotor assembly.

In operation, initially discharged jets comprising liquid coolant are impinged on the inner surface of the perforate member (and on the vanes if provided) to effect both formation of a liquid film at least on the perforate member as well as rotation of the ring. Centrifugal force of the ring holds the liquid film against the radially inner surface of the perforate member at least substantially throughout the entire circumferential extent thereof. The subsequently discharged jets impinge onto the film effecting both continuance of ring rotation and replenishment of the film as liquid therefrom is discharged outwardly sequentially through holes 34, port 31, and through annular slot 42 extending radially through casing 16. The liquid film absorbs a substantial amount of the momentum and energy of the high velocity jets (accelerated to a tangential velocity component equal to the tangential velocity of the hole containing terminals 26 on the outer periphery of the rotor assembly), thereby substantially minimizing the erosive effects of the jets which heretofore have typically required employment of exotic hard surface materials or coatings thereof on the casing or other stationary parts exposed to the jets.

The rotational speed of the rotating ring is maintained at a rate which is less than the rotational speed of the outer periphery of the rotor assembly. This lower speed can be accommodated, at least in part, by the frictional forces of the bearings on the rotatable ring. Desirably, means are included for controlling the maximum rotational speed of the ring at a value sufficiently less than the speed of the rotor assembly outer periphery such that the velocity of liquid coolant exiting from the ring, as through slot 42 in the stationary casing, is less than about 50 percent of the average velocity of the liquid coolant discharged from the outlets 28. Such means, not illustrated, for controlling the speed of rotating members are well known in the art. Such means may be, for example, simply a brake engaging the ring. Another suitable means is an external power absorption means, e.g. an electrical generator driven by a shaft mechanically linked to the ring, as by a roller. Ring speed controlling means including an energy conversion load driven by the ring, such as the aforementioned generator, advantageously recover energy from the rotating ring which might otherwise be wasted. Well known control systems may be incorporated to precisely control the speed of the rotating ring.

In the best mode contemplated, the rotor would be rotated at a speed of about 3600 rpm, corresponding to a tangential velocity at the outer periphery thereof of about 1500 feet per second for a 90-inch diameter rotor and the annular rotating ring would be controlled at a speed of about 500 to 750 feet per second tangential velocity. Accordingly, the velocity of the liquid coolant exiting through casing slot 42 would be approximately 50 percent to 33 percent of the tangential velocity of the liquid jets leaving the rotor assembly. Since the erosive rate of liquid coolant jets such as water jets varies with the 5th to 7th power of jet velocity, the erosive power of exit coolant liquid on the stationary casing will be substantially reduced by this invention.

The distance between the radially inner surface of the perforate member and the outer periphery of the rotor assembly through which the liquid coolant exits may be of any suitable value (e.g., from about ½ to about 2 inches, preferably about 1 inch).

The various illustrated components of the turbine may be formed of any suitable materials, e.g., nichel-base super-alloy, stainless steel, etc. The best material construction for the perforate member and, where included, the vanes is stainless steel.

BEST MODE CONTEMPLATED

The best mode contemplated for carrying out this invention has been set forth in the description above, for example, by way of setting forth preferred structural arrangements and materials of construction and other unobvious variables material to successfully practicing (including making and using) the invention in the best way contemplated at the time of executing this patent application.

It is understood that the foregoing detailed description is given merely by way of illustration and that many modifications may be made therein without departing from the spirit or scope of the present invention.

What is claimed is:

1. A turbine machine comprising:

(a) a stationary casing having a radially inner surface, (b) a rotor assembly mounted for rotation within and relative to said casing and having a plurality of outlets adapted to discharge high-velocity jets comprising liquid coolant toward said radially inner surface, (c) an annular ring disposed intermediate said casing and said rotor assembly, said ring being mounted for rotation substantially about the axis of rotation of said rotor assembly at an angular speed different from the angular speed of said rotor assembly.

2. The turbine machine of claim 1 wherein (d) a trough assembly is provided in said ring, said trough assembly comprising:

(i) an annular recess opening inwardly toward the axis, (ii) an annular port opening toward the casing, (iii) an annular perforate member disposed between said recess and said port, said perforate member having a plurality of holes through which the port and recess are in flow communication, said holes being sufficiently small in total transverse sectional area such that liquid coolant impinging on the trough is contained therein in the form of a film on the perforate member and the ring rotates in response to impingement of the high velocity jets on said film.

3. The turbine machine of claim 1, wherein said rotor assembly includes a rotor disc and a plurality of turbine buckets mounted on the periphery of the disc, each bucket having at least one of said outlets.

4. The turbine machine of claim 3, wherein each bucket is connected at its distal end to a shroud and each shroud having at least one of said outlets.

5. The turbine machine of claim 1, wherein said outlets are disposed in uniformly spaced apart relationship circumferentially of said rotor assembly.

6. A turbine machine of claim 1, including means for controlling the maximum rotational speed of the ring at a value less than the speed of the rotor assembly, 7. The turbine machine of claim 6, wherein said value is sufficiently less than the speed of the rotor assembly such that the velocity of liquid coolant discharged from said ring is less than 50% of the average velocity of the liquid coolant discharged from said outlets.

8. The turbine machine of claim 6, wherein the ring speed controlling means includes an energy conversion load driven by said ring.

9. The turbine machine of claim 1, wherein said ring is rotatably supported by bearings carried by said casing.

10. The turbine machine of claim 2, wherein a plurality of uniformly spaced apart vanes project radially inwardly from said perforate member.

11. The turbine machine of claim 2, wherein the radial distance between said perforate member and the radially outer periphery of said outlets is from about ½ to about 2 inches.

12. In a process of open circuit liquid cooling a turbine rotor assembly wherein high velocity jets comprising spent liquid coolant are discharged outwardly from the rotor assembly toward the turbine casing, the improvement which comprises:

(A) providing an annular ring intermediate said casing and said rotor assembly with said ring being mounted for rotation substantially about the axis of rotation of the assembly, said ring having a trough assembly including (i) an annular recess opening inwardly towards said rotor assembly and in register with liquid coolant discharge outlets provided therein, (ii) an annular port opening toward the casing, and (iii) an annular perforate member disposed between said recess and said port, said perforate member having a plurality of holes through which the port is in flow communication with said recess, the total cross sectional area of said holes being sufficiently small such that a body of liquid coolant discharged from said outlet and impinging on said perforate member can be contained therein in the form of a film, (B) impinging initially discharged liquid-coolant-containing jets on the perforate member to effect both formation of a liquid film thereon and rotation of the ring, and (C) impinging subsequently discharged jets onto said film to both continue rotation of said ring and replenishment of said film as liquid portions thereof are discharged outwardly through the trough assembly.

13. The process of claim 12, wherein said ring is rotated at an angular speed of less than the angular speed of rotation of said rotor assembly.

14. The process of claim 13, wherein the speed of the ring is maintained at a speed sufficiently less than the speed of the rotor assembly such the velocity of liquid coolant exiting from the ring is less than about 50% of the average velocity of the liquid coolant discharge from said outlets.

15. The process of claim 12, wherein said liquid coolant is water.

* * * * *